US008677521B2

(12) United States Patent
Stimpson

(10) Patent No.: US 8,677,521 B2
(45) Date of Patent: Mar. 25, 2014

(54) SHOWER FLOOR FORMERS

(75) Inventor: Robert William Stimpson, British Isles (GB)

(73) Assignee: DLP Limited, Isle of Man (GB)

( * ) Notice: Subject to any disclaimer, the term of this patent is extended or adjusted under 35 U.S.C. 154(b) by 1131 days.

(21) Appl. No.: 12/579,675

(22) Filed: Oct. 15, 2009

(65) Prior Publication Data

US 2011/0088161 A1 Apr. 21, 2011

(51) Int. Cl.
*A47K 3/00* (2006.01)
*A61H 35/00* (2006.01)

(52) U.S. Cl.
CPC ..... *A61H 35/00* (2013.01)
USPC ..... 4/613

(58) Field of Classification Search
USPC ..... 4/613, 604; 29/248
See application file for complete search history.

(56) References Cited

U.S. PATENT DOCUMENTS

| | | | | |
|---|---|---|---|---|
| 3,457,568 | A * | 7/1969 | Amatruda | 4/613 |
| 4,091,477 | A * | 5/1978 | Lewis et al. | 4/597 |
| 5,140,789 | A | 8/1992 | De Gooyer | |
| 6,941,703 | B2 * | 9/2005 | MacLean et al. | 52/34 |
| 8,239,974 | B2 * | 8/2012 | Erlebach | 4/291 |
| 2008/0189926 | A1 * | 8/2008 | Luxton | 29/428 |
| 2011/0088160 | A1 | 4/2011 | Stimpson | |

FOREIGN PATENT DOCUMENTS

| | | |
|---|---|---|
| DE | 102007010598 | 9/2008 |
| DE | 202009003185 | 7/2009 |
| EP | 1782721 | 2/2006 |
| GB | 2361637 A | 10/2001 |
| GB | 2401341 A | 11/2004 |
| GB | 2429981 A | 3/2007 |

OTHER PUBLICATIONS

European Search Report and Written Opinion EP10251759.6 dated Mar. 14, 2013.
Office Action dated on Nov. 7, 2012 for U.S. Appl. No. 12/579,527.

* cited by examiner

*Primary Examiner* — Lori Baker
(74) *Attorney, Agent, or Firm* — Fleit Gibbons Gutman Bongini & Bianco PL; Paul D. Bianco; Gary S. Winer

(57) ABSTRACT

A former creates a sloping profile for waste-water run off below a waterproof floor covering of a shower area. The former is made of a molded or cast plastics material and has sloping surfaces converging to define an integral linear drainage trough having upstanding side walls and a base, the base of the trough containing at least one predefined drainage hole for connection to a shower waste. The former may be covered with a flexible waterproof floor covering, the covering placed between the sides of the trough and a support frame, and retained in position by fasteners through the frame and trough. A perforated drainage cover is mounted on and secured to the support frame by fasteners.

19 Claims, 2 Drawing Sheets

SHOWER FLOOR FORMERS

FIELD OF THE INVENTION

This invention relates to improvements in the construction of shaped floor formers placed below waterproof flooring materials to form a sloping surface within showering rooms often for the use by the disabled, the profile of which permits the collection of water from the floor of the shower into a waste collection trap or gully device for the shower area.

BACKGROUND OF THE INVENTION

When providing shower access for disabled users in wheelchairs, the state of the art, established over many years, was to provide a sloping floor structure which is rigidly located below a waterproof membrane or surface coating glued or bonded to the underlying structure surface. Commercial products such as Altro™ have lead the UK market for such applications for many years, and commercial product literature has shown the application of such materials to a wide variety of flooring structures. The ideal shower for the disabled wheelchair-bound user is thus located within a room which provides a waterproof floor which slopes towards the waste drain, and presents no obstacles to hinder the wheelchair user from accessing the facility.

In the past, the slope of floors has been created by sections of plywood (see, for example, U.S. Pat. No. 5,140,789) jointed and laid onto a supporting wooden structure of timber joists. Past state of the art has also included woven glass fabric reinforced sheets (GB 2361637B)—where the strength of the structure has been obtained by using relatively expensive woven glass fibre fabric of two or more horizontal layers linked by an interwoven cross-layer within a resin matrix. Further examples of prior state of the art also include the flooring structure employed in modular or 'pod' showering and bathing modules used within the hotel, hostel and marine/offshore construction industries, where the purpose of the floor slope is water containment rather than disabled person accessibility.

Current art employed by the applicant (GB2401341) comprises a glass fibre reinforced plastics (referred to hereinafter as GRP) structure comprising gel coat backed by random chopped strand mat glass fibre reinforcement with plywood timber sections bonded into the lower surface with additional random chopped strand mat, the entire material combination being moulded with a thermosetting resin to create a rigid load carrying and water proof shower floor former structure. The former is formed to create a sloping profile for waste-water run off below a waterproof floor covering of a shower area. The former has a plurality of sloping, curvedly truncated generally triangular facets which converge on a common circular hole shaped to accept a waste trap or gully. A circular adaptor and/or tile adaptor with clamping element and grid cover are then secured over the hole to secure a flexible waterproof floor covering thereto or to allow a tiled floor covering to lie flush with the grid cover of the tile adaptor. A shower waste is connected beneath the former. This arrangement, although satisfactory, can be difficult to install and may lead to jointing and leakage problems.

The present invention aims to provide an improved shower floor former that minimises jointing and leakage problems and aids installation of the product.

SUMMARY OF THE INVENTION

Accordingly, a first aspect of the present invention provides a former for creating a sloping profile for waste-water run off below a waterproof floor covering of a shower area, wherein the former is made of a moulded or cast plastics material and has sloping surfaces converging to define an integral linear drainage trough having upstanding side walls and a base, the base of the trough containing at least one predefined drainage hole for connection to a shower waste.

In a preferred embodiment, the trough has means of engagement for clamping or retaining means for a waterproof flexible floor covering or tiled floor drainage grating abutment device.

The sloping surfaces of the former are preferably trapezoid facets. The inner sides of the facets which define the perimeter of the trough are preferably stepped to provide at least one flange extending around the perimeter of the trough. A series of preformed holes or recesses are preferably provided within each flange. The base of the trough preferably slopes towards the predefined drainage hole.

A linear support frame and perforated cover may be provided for mounting in the trough. To this end, a second aspect of the present invention provides a wet floor former according to the first aspect of the present invention in combination with a support frame and perforated cover mounted in the linear trough.

Preferably, the support frame has planar sides which lie on a respective flange formed in the sides of the trough of the former. Each side may include a generally L-shaped lip extending upwardly therefrom which follows the profile of the sides of the trough.

The support frame preferably includes at least one crossbar between the sides of the frame. More preferably still, the cross bar may include a raised support member extending upwardly therefrom.

Preformed holes are preferably provided in the support frame in a position that corresponds to the positioning of the preformed holes or recesses in the trough of the former.

A flexible waterproof floor covering material may be placed between the sides of the trough and the support frame, being retained in position by fastening means provided through the holes in the frame and the trough. Suitable fasteners include, for example, threaded inserts.

The perforated cover is preferably seated on the support frame and secured thereto by fastening means. In a preferred embodiment, the cover has a generally n-shaped cross-section with the depending limbs 32 being received between the fastening means and the lip of the support frame. If a tiled flooring cover is to be installed on top of the former, one or more spacer inserts may be provided between the former and the support frame and/or the support frame and cover to raise the level of the top surface of the cover to lie flush with the top surface of an installed tile.

According to a third aspect of the present invention, there is provided a wet floor shower waste comprising a former according to the first aspect of the present invention connected to a shower waste and provided with a wet floor covering, such as a flexible waterproof floor covering or tiles. A fourth aspect of the present invention provides a kit of parts for forming a wet floor shower waste with a wet floor covering comprising a former according to the first aspect of the present invention, a wet floor covering material, a support frame, a perforated cover and a pipe coupling for connection to a waste water outlet.

The former is preferably manufactured from sheet moulding material, although any thermosetting or thermoplastic moulding process may be used, with single or double sided mould production methods, including but not limited to mineral filled thermosetting resin casting processes.

The former is preferably comprised of a hot pressed glass fibre reinforced plastics material. The material of the former may comprise a thermosetting plastics resin matrix within which can be short glass fibre random strands in the case of Bulk Moulding Compound (BMC). One such compound is Hepworth Composites Bulk Moulding Compound Grade HEP-BMC107. Alternatively, the material may comprise a thermosetting plastics resin matrix within which are longer random chopped glass strand matting, formed into uncured sheets and known as Sheet Moulding Compound (SMC). One such compound is Hepworth Composites Sheet Moulding Compound Grade PG25-J162WH. The present invention permits the materials used in the former to be selected and blended or combined to create a material which when processed formed and cured into a solid material has preferred material properties which may include but are not limited exclusively to tensile strength and or impact resistance and or colour.

BRIEF DESCRIPTION OF THE DRAWINGS

The invention will now be described, by way of example, with reference to the accompanying drawings in which.

DETAILED DESCRIPTION OF THE INVENTION

Figure 1:
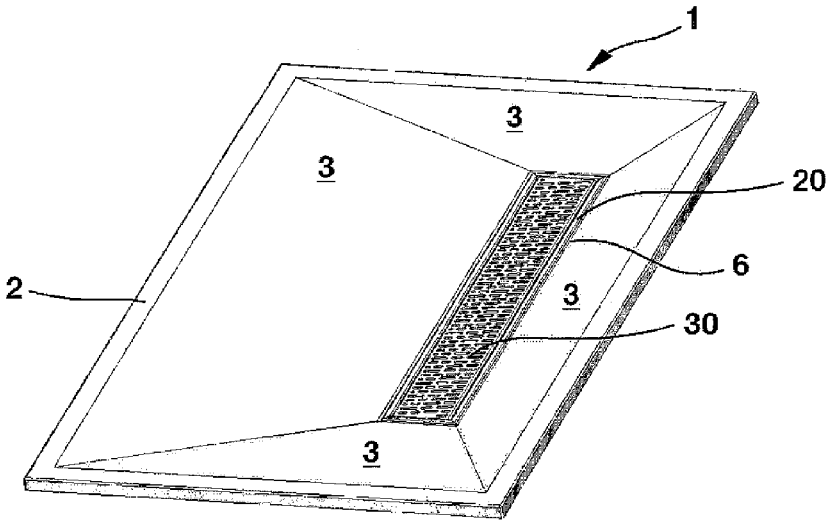
FIG. 1 is an isometric view from above of one embodiment of a former according to the present invention, shown provided with a perforated drain cover.
Figure 2:
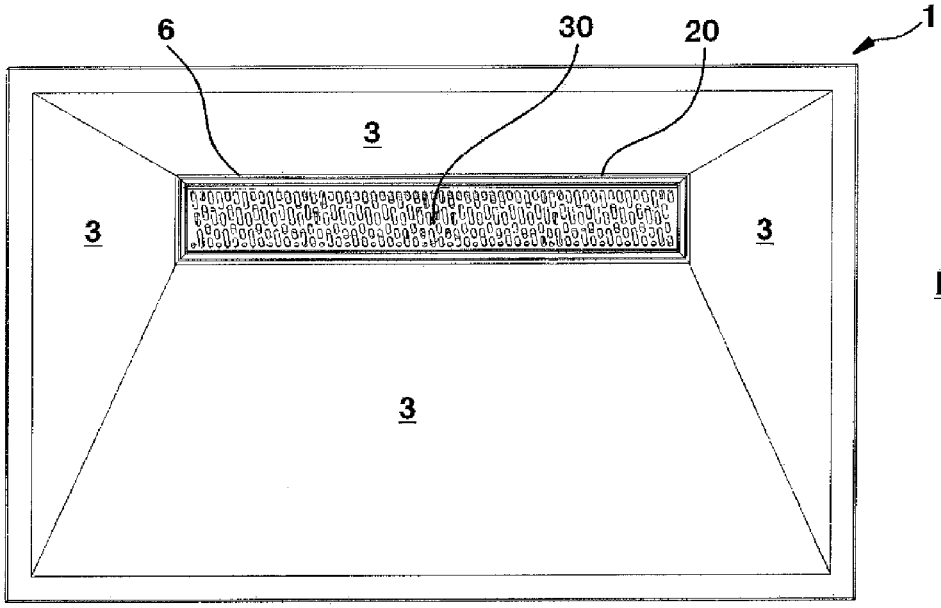
FIG. 2 is a plan view from above of the embodiment shown in FIG. 1.
Figure 3:
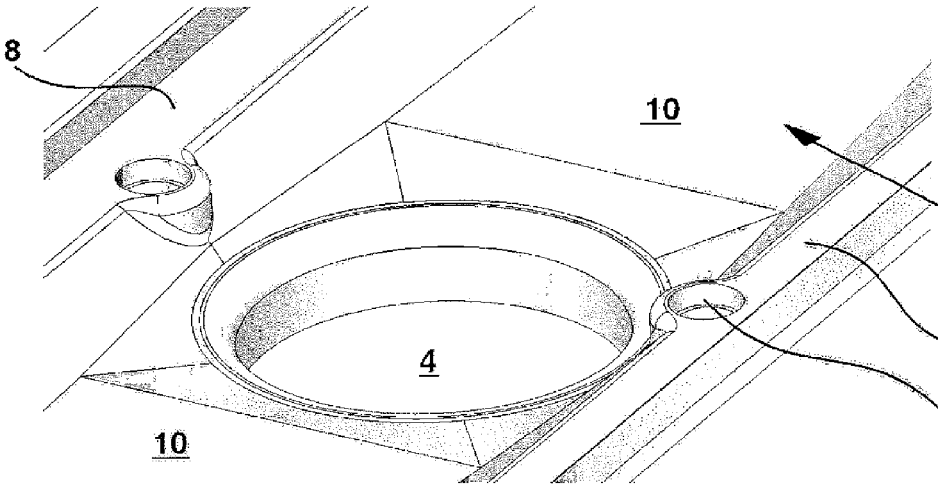
FIG. 3 is an enlarged detail view of a drainage hole of the former of FIG. 1, shown without the perforated cover.
Figure 4:
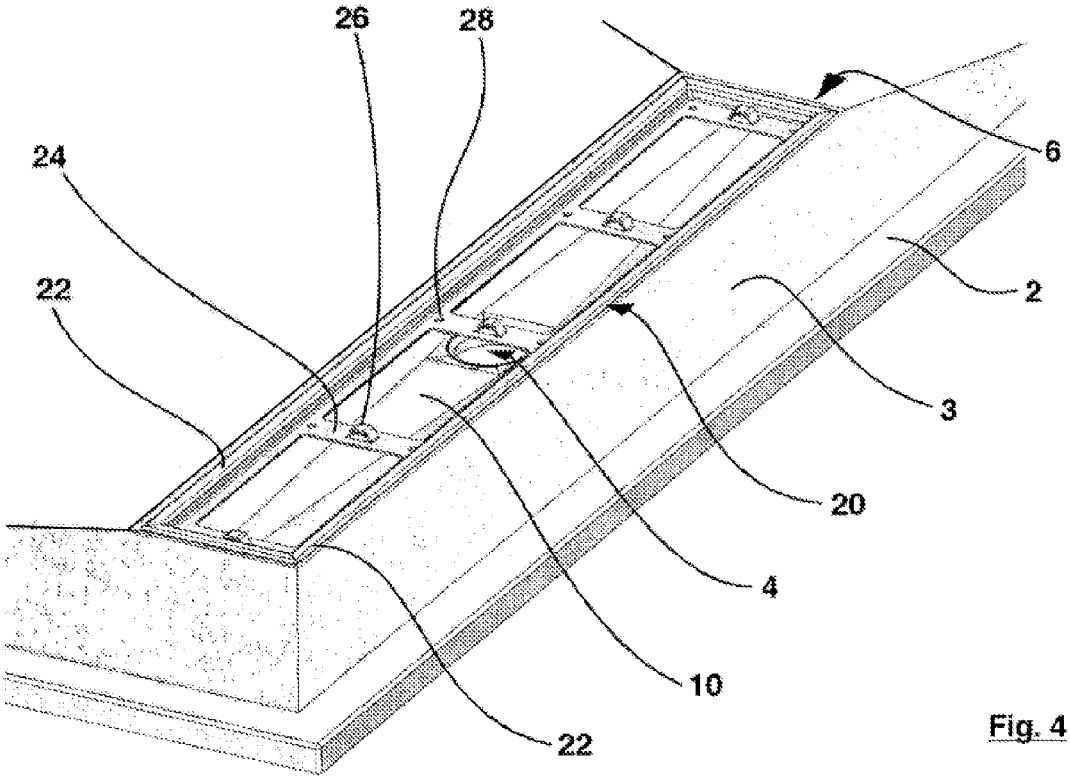
FIG. 4 is an enlarged detail view of the rectangular trough of the former of FIG. 1, shown with a support frame but without the perforated cover.

Referring to the accompanying drawings, one embodiment of a shower floor former according to the present invention is illustrated. The former comprises a formed rectangular solid body 1, having a level outer border edge 2 surrounding four sloping, generally trapezoid facets 3 (i.e. each facet having four sides, one pair of opposite sides being parallel), preferably with two facets being isoceles trapezoids. The innermost sides of the facets define sides of a rectangular linear trough 6 that contains one or more circular drainage holes 4 for connection to a waste drainage pipe or fitting (not shown). The perimeter border may be beneficially provided with a plurality of pre-formed fixing holes (not shown) allowing the former to be fastened down to the underlying floor structure with no additional modifications to the former.

The linear trough 6 of the former is provided with stepped sides 8 and a base 10 which slopes towards the drainage hole 4. Multiple drainage holes may be provided at spaced intervals in the base of the trough, with the section of the base in the viscinity of a particular drainage hole being sloped towards that hole. The area immediately surrounding the drainage hole may have sloping sides of increased gradient to assist the flow of water therethrough. A flange 8 provided by the stepped sides of the trough contains pre-formed blind holes 12 for receiving threaded fasteners or other suitable fixing means. For example, the "309" series of brass threaded insert products manufactured by Kerb Konus Limited. A rectangular support frame 20 is received on the flange 8, the frame having four planar sides which lie on the four flanges provided by the stepped sides, each planar side having a generally L-shaped lip 22 extending upwardly therefrom for following the profile of a side of the trough. The support frame 20 is also provided with a plurality of spaced apart crossbars 24 extending between the longitudinal side walls of the trough, the cross bars having raised support members 26 and having preformed holes 28 which are located such as to correspond to the positioning of the preformed holes 12 in the sides of the trough.

Figure 5:
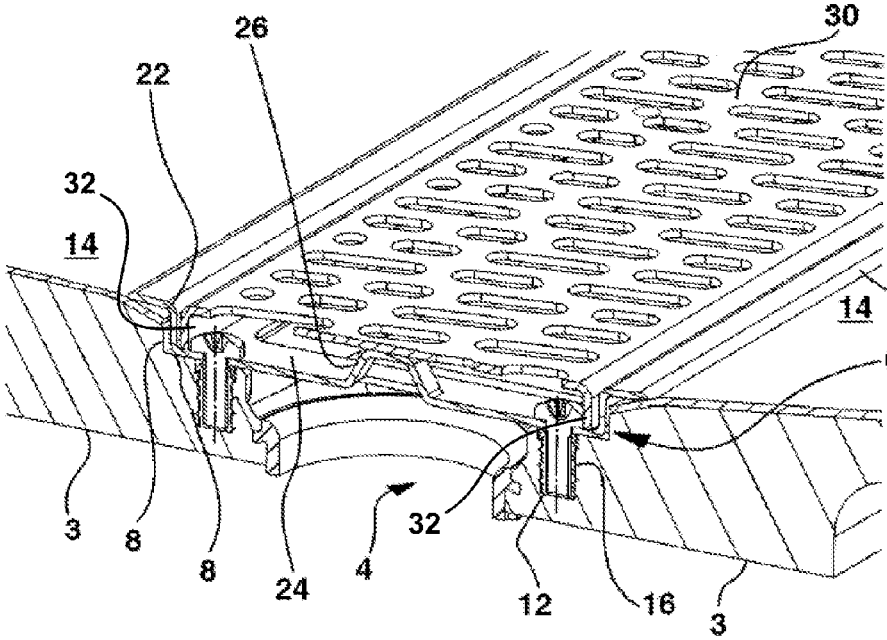
FIG. 5 is a cross-sectional view of the rectangular trough of the former of FIG. 1, shown with the support frame and perforated cover.

The support frame 20 is able to accept a rectangular perforated drainage cover 30 (see, in particular, FIG. 5) and also acts as a clamping element to retain a flexible waterproof flooring material (not shown). The edge of the flooring material 14 is clamped between the support frame 20 and former 1 and the support frame is retained in place by means of the threaded fasteners 16 provided through the frame and received in the preformed holes 12 in the former. The elongated rectangular perforated cover 30 is generally n-shaped in cross-section with depending limbs 32 of the cover being received within a recessed ledge provided between the threaded inserts 16 and the lip 22 of the support frame. The raised support members 26 are substantially the same height as limbs 32 of the cover thereby enabling the members to provide spaced apart supports along the central length of the cover. This arrangement enables the relative position of the perforated cover to the floor covering to be maintained.

During installation, a threaded dip tube or drainage pipe coupling (not shown) is passed through the drainage hole 4 for connection to a waste which may be trapped or non-trapped, pumped or gravity-fed. The upper end of such a tube may be provided with a mounting cap or feature with drainage apertures therethrough, the cap providing an annular flange clamp that engages around the perimeter of the trough that surrounds the drainage hole. A waterproof flexible floor covering 14 may then be sandwiched between the former and the support frame 20 and is fastened in place by screw-threaded fasteners 16, preferably being of brass or stainless steel, that are received within the preformed holes or recesses 12. The removable grid cover 30 is then releasably fastened or located on the support frame to provide a flush finish.

The trough may be provided with multiple drainage holes or recesses in its base which may be drilled through to enable multiple traps to be fitted thereto to increase the water disposal flow rate.

The fixing holes for attaching the former to the floor may be countersunk cylindrical holes for wood-screws, but may also be of another shape to accept another fastener or alternative fixing method. The fixing holes may additionally be shaped to accept covers or plugs which may be added to the upper surface as an alternative to the preferred embodiment which is to apply a flexible, curable filler material to the installed fixing upper surface.

Engraved or embossed textual and/or symbolic instructions may be formed into the upper surfaces of the former component 1, which can be easily seen by the installer. This permits rapid, safe and correct installation of the former with minimal reference to the installation instructions. Also engraved or embossed textual and/or symbolic instructions may be formed into the lower surfaces of the former component, which can also be easily seen by the installer prior to installation. This permits the application, by way of example, of company logos, safety and/or material recycling symbols, batch and/or date of manufacturing information, to be added to the surfaces of the former. Contact telephone numbers and internet addresses can be added in a similar manner.

An improved load distribution from the shower floor former onto the underlying floor structure may be provided by creating a multiplicity of individual or crossed reinforcing ribs (not shown) on the flat lower locating surface which transmit the loading of user and wheelchair through the shaped former structure 1 and into the underlying floor structure (not shown). The SMC or BMC manufacturing process allows a higher density of ribs per unit area of former than is possible with any other manufacturing process since the depth of the ribs may exceed the width, permitting them to be located in close proximity to each other. The ribs also prevent or even eliminate slippage during installation of the former by allowing the underside of the former to embed into soft sand and cement screed (also known as cement mud) whilst levelling the former.

The former of the present invention is also suitable for direct use with tiled flooring due to the linear nature of the waste trough and cover. Spacers may be provided between the former and the support frame to raise the level of the grid cover so that top surface of the tiles can lie flush with the upper surface of the cover. The retaining screws can be fastened down to rigidly locate the centre grid support frame whilst the floor is grouted and the tiles installed.

The position of the drainage hole or holes within the former is preferably offset from centre in two mutually perpendicular directions to aid avoidance of joints during its installation.

It is thus possible to provide a single kind of wet floor former which can be used when installing either a tiled floor or flexible waterproof floor covering material with minimal effort. The former of the present invention removes the need for a dedicated stainless steel trough which is typically inserted into the wet-floor former, which is itself weakened by the large rectangular recess within it. The arrangement allows for a thinner wet floor former which is also stronger whilst eliminating the cost of a trough in a separate material. The reduced number of parts also aids installation of the shower wet floor former. The linear waste profile also minimises jointing and leaking problems.

The embodiments described above are given by way of examples only, and modifications will be apparent to persons skilled in the art without departing from the scope of the invention as defined by the appended claims.

The invention claimed is:

1. A shower floor former for a shower area having a waterproof floor covering, the former comprising:

a moulded or cast plastics material having sloping surfaces which converge downwardly to an integral lower linear drainage trough, the lowermost edges of the sloping surfaces defining a perimeter of the linear drainage trough, the linear drainage trough having upstanding side walls and a base which is below the sloping surfaces, the base of the trough containing at least one predefined drainage hole for connection to a shower waste, the base of the trough having a sloping profile for waste water run-off, the base being below the waterproof floor covering of the shower area when the former is installed, the base thereby configured to collect waste water run-off from the waterproof floor covering;

a linear perforated drainage cover sized to fit within the linear drainage trough and to not extend over the sloping surfaces; and a support frame including planar sides which lie on a step provided in and around sides of the trough, the support frame thereby configured to support the drainage cover whereby the drainage cover is substantially flush with the lowermost edges of the sloping surfaces when the support frame is positioned upon the step in the trough.

2. The shower floor former of claim 1, the trough and the support frame together forming a clamp configured for clamping a waterproof flexible floor covering to the trough.

3. The shower floor former of claim 1 wherein the sloping surfaces are in the general form of trapezoid facets with the inner sides of the facets defining the perimeter of the trough.

4. The shower floor former of claim 3 wherein the perimeter of the trough is stepped to provide at least one flange extending around the trough.

5. The shower floor former of claim 1, wherein the support frame has planar sides which lie on a flange provided around the sides of the trough, each side of the frame having a generally L-shaped lip extending upwardly therefrom which follows the profile of a side of the trough.

6. The former of claim 1, wherein the support frame and trough have a series of complimentary predefined holes or recesses for receiving fasteners whereby the support frame is fastened to the former.

7. The shower floor former of claim 1, wherein the cover is generally n-shaped in cross-section and the depending limbs of the cover are supported on the support frame.

8. A wet floor shower waste comprising the shower floor former of claim 1 connected to a shower waste and provided with a tiled floor covering, a support frame and a perforated drainage cover, wherein at least one insert is placed between the trough and the support frame and/or the support frame and the cover to raise the height of the cover to lie flush with an upper surface of the tiled floor covering, the support frame being retained in position by one or more fasteners extending through the frame and into the trough, the perforated cover being seated on the support frame and secured thereto by one or more fasteners.

9. A kit of parts for a wet floor shower waste comprising a shower floor former as claimed in claim 1, a wet floor covering material, a support frame, a perforated drainage cover and a pipe coupling for connection to a waste water outlet.

10. A shower floor former, comprising:

a drainage flooring having a plurality of facets sloping downwards from an outer periphery to an inner periphery, the facets turning downwards at the inner periphery to form innermost sides of a lower linear trough, the lower linear trough having at least one drainage hole at a lower portion connectable to a shower waste, and a peripheral supporting at an upper portion below the inner periphery;

a support frame including planar sides and an underside configured to lie upon the peripheral supporting flange;

a linear perforated drainage cover sized to overlie and be supported by the support frame, the drainage cover sized to cover an opening to the lower linear trough.

11. The shower floor former of claim 10, the support frame forming a clamp configured to secure a flexible floor covering to the shower floor.

12. The shower floor former of claim 10, wherein the drainage cover includes a planar support portion having openings to admit passage of water, and opposed limb portions engageable with the support frame.

13. The shower floor former of claim 12, the support frame forming a clamp portion configured to clamp a flexible floor covering to the shower floor, the clamp portion extending from the support frame to pass between the innermost sides of the lower linear trough and the limbs portions of the drainage cover, and then extending over a portion of the floor covering when the former is installed beneath the floor covering.

14. The shower floor former of claim 10, wherein the lower portion of the linear trough includes a plurality of sloping further facets surrounding the drainage hole.

15. The shower floor former of claim 14, wherein the sloping further facets have a greater sloping pitch than the first said facets of the drainage flooring.

16. The shower floor former of claim 10, further including spacers configured to raise the drainage cover substantially above a level of the drainage floor.

17. A shower floor former for a shower having a waterproof floor covering, the former comprising:

a moulded or cast plastics material having sloping surfaces converging downwards to define a linear drainage trough below the sloping surfaces and having upstanding side walls and a base, the base of the trough containing at least one predefined drainage hole for connection to a shower waste, a portion of the material configured to be installed below a waterproof floor covering of a shower area, thereby being configured to collect waste water run-off from the waterproof floor covering;

a linear perforated drainage cover sized to cover the linear drainage trough; and a support frame including planar sides which lie on a step provided in and around sides of the trough, the support frame thereby configured to support the drainage cover whereby the drainage cover is substantially flush with the waterproof floor covering when the drainage cover is positioned upon the support frame; and a clamp formed between the support frame and the base, the clamp thereby configured to clamp the waterproof floor covering therebetween.

18. The shower floor former of claim 17, wherein at least one fastener extends through the support frame and into the base to mutually secure the support frame and base together to form the clamp, without a requirement of passing a fastener through the waterproof floor covering.

19. The shower floor former of claim 2, wherein the sloping profile includes at least two sloping surfaces disposed at an angle relative to each other, including a first profile disposed beneath a clamping portion of the support frame, and a second profile extending away from the clamping portion and extending in a direction away from the drainage hole.

* * * * *